US007806409B1

(12) United States Patent
Cardenas

(10) Patent No.: US 7,806,409 B1
(45) Date of Patent: Oct. 5, 2010

(54) ELECTRONIC DART FOOTBALL GAME

(76) Inventor: Robert Carl Cardenas, P.O. Box 32110, Sarasota, FL (US) 34239

( * ) Notice: Subject to any disclaimer, the term of this patent is extended or adjusted under 35 U.S.C. 154(b) by 0 days.

(21) Appl. No.: 12/246,645

(22) Filed: Oct. 7, 2008

(51) Int. Cl.
*F41J 5/04* (2006.01)
*F41J 3/00* (2006.01)

(52) U.S. Cl. ..... 273/371; 273/409

(58) Field of Classification Search ..... 273/403–410, 273/371–377
See application file for complete search history.

(56) References Cited

U.S. PATENT DOCUMENTS 2,227,382 A * 12/1940 Salter ..... 273/409
2,458,388 A * 1/1949 Kobs ..... 273/247
D158,950 S * 6/1950 Fleming ..... D21/307
D167,971 S * 10/1952 Costenbader ..... D21/307
D200,418 S * 2/1965 Olson ..... D21/307
D224,122 S * 7/1972 Tremel et al. ..... D21/357
D229,207 S * 11/1973 Stitzer ..... D21/307
3,979,117 A * 9/1976 Worsham ..... 273/408
D257,482 S * 11/1980 Leduc ..... D21/307
D285,942 S * 9/1986 Kemmeter ..... D21/307
D287,144 S * 12/1986 Dunn ..... D21/307
4,681,325 A * 7/1987 Sheem ..... 273/348.3
D293,455 S * 12/1987 Castro et al. ..... D21/308
4,893,822 A * 1/1990 Tesa et al. ..... 273/376
5,005,842 A * 4/1991 Bauer ..... 273/408
5,664,782 A * 9/1997 Lacks et al. ..... 273/317.5
5,967,518 A * 10/1999 Rowe ..... 273/317.5
5,979,898 A * 11/1999 Pan ..... 273/371
D444,505 S * 7/2001 McGinnis ..... D21/308
6,402,154 B1 * 6/2002 Hess et al. ..... 273/317.5
2005/0062232 A1 * 3/2005 Pavlik et al. ..... 273/408

* cited by examiner

*Primary Examiner*—Mark S Graham
(74) *Attorney, Agent, or Firm*—Dorothy S. Morse

(57) ABSTRACT

An electronic dart game allowing players to control and more closely simulate the offensive and defensive strategies of a game of football when compared to other dart games with a football theme. Each player can use remaining time on the clock to advantage, and continue play in first down increments, as long as minimum yardage gains are made in the time intervals allowed. The player starts anew with four darts each time a first down is achieved. Darts can score yard gains, yard losses, passes, fumbles, and interceptions. Punting and field goals can be attempted if clearly indicated in advance of throwing a dart. One distinction from a real football game is that there are no time outs, and players cannot stop the clock. A main computer control chip preferably coordinates the game board and scoring/control board used and maintains all aspects of the game in sequence once play begins.

22 Claims, 2 Drawing Sheets

ELECTRONIC DART FOOTBALL GAME

CROSS-REFERENCES TO RELATED APPLICATIONS

None

BACKGROUND

1. Field of the Invention

This invention relates to the field of games involving the use of darts, specifically to an electronic dart game that allows players to control and more closely simulate the offensive and defensive strategies of a regulation football game when compared to other dart games with a football theme. A coin toss preferably determines which player or team will go first and which end zone each defends, as in regulation football. Once the game clock is set to establish the length of the quarters (typically five, ten, or fifteen minutes) and the possession clock is set to establish the time allowed for the dart throwing player to use a maximum of four darts to make a first down (typically twenty-five, thirty-five, or forty-five seconds), the first player starts the game by throwing one dart toward the game board. Contact of the first dart against the game board activates the scoring/control board. The first dart throwing player starts first-and-ten on his own 20-yard line, with four darts and eighty yards-to-go. The dart throwing player can then use the time remaining on the game clock to advantage, playing in first down increments or attempting to score a field goal (only when the dart throwing player is thirty yards or less to the scoring goal). The game board is vertically oriented with a larger goal post at the top (used for the award of an extra point after a touchdown), and a smaller goal post at the bottom (used to score field goals). Each time a first down is achieved (minimum of 10-yard gain toward the scoring goal from the line of scrimmage, as in regulation football), the dart throwing player (or a teammate) starts anew with four more darts to attempt to make another first down, or score a field goal (if close enough to the scoring goal line). Yard loss causing the dart throwing player to travel backward beyond his or her own goal line will result in a touch back and the award of two points to the opposing player or team. Should the dart throwing player lack success in hitting areas of the game board that award yard gains, on the third or fourth down the dart throwing player can punt. Punts and field goal attempts must be clearly announced in advance with activation of a button on a hand-held remote control device connected to the scoring/control board, so that the scoring/control board will take appropriate scoring and ball placement action after the "punting" dart is thrown. In addition to the difference in size of the two goal posts used in its end zones, another important difference from the play in a real/regulation football game is that the present invention does not include time outs. No player can stop the clock, only the referee can. An additional difference is that in the present invention end zone changes occur more frequently than in regulation football, with players switching end zones after every successful field goal attempt in addition to the end of each quarter, whereas in regulation football the teams only switch end zones at the end of each quarter. Also, in the most preferred embodiment of the present invention electronic dart football game, there is only one referee (who is selected by both of the players or teams as the arbiter of all disputes). Although not limited thereto, at a minimum the scoring/control board of the present invention preferably includes visual display of the following information, time remaining in the game (game clock), home team score, visitors score, location of the ball on the field, identification of the team having possession of the ball, time remaining for making a first down (possession clock), the period of play (whether $1^{st}$, $2^{nd}$, $3^{rd}$, or $4^{th}$ quarter), and the down being played and yards-to-go (such as $1^{st}$ and 10, $2^{nd}$ and 5, $2^{nd}$ and 20, $4^{th}$ and 1, etc.). The entire simulated football field of the present invention (area between the two goal lines) is a target for thrown darts, with different areas representing yard gains and losses, as well as passes, fumbles, penalties, and interceptions. The end zones in the present invention typically have penalty areas (can resemble a referee) and may optionally have at least one area where a higher-value yard gain can be achieved as a result of a pass completion. While use of the game board without the scoring/control board and hand-held remote control device is possible, if manual scoring and timing are used, however, the pace of a manually-scored game is slower and generally less desirable than when the scoring/control board and hand-held remote control device are present and the players need only to be concerned with game strategy.

2. Description of the Related Art

Many dart games with a football theme are known, however, none of them allows players to control and more closely simulate the offensive and defensive strategies of a regulation football ball game than the present invention. For example, the invention disclosed in U.S. Pat. No. 4,893,822 to Tesa (1990) has a game board with a football field generally patterned after that used in a regulation football ball game, with opposing end zones each having a goal post and areas between the goal lines that marked in 10-yard increments, similar to that of the present invention. The Tesa invention even has a scoreboard with a time clock, visible display of accumulated points for each player or team, and yard line ball location indicators for the home and visiting teams. Yet the football-shaped markings on the Tesa football field comprise two spaced-apart rows of lights that display ball position for either the home or visiting team according to who is in current possession of the ball. Thus, the football-shaped markings on the Tesa field are not dart-directed targets that when hit will award yard gains and losses to the player throwing a dart, or force the dart throwing player to give possession of the ball to the opposing player or team, as in the present invention. Furthermore, the football field displayed on the face of the Tesa invention is placed into a horizontally-extending orientation during game play, with one end zone being positioned to the left of players and the other positioned to their right, whereas the field display on the present invention is used in a vertically-extending orientation that more closely simulates the view a regulation football player would have of a game field. In addition, in the present invention the first player and each player starting after a touchdown is scored, starts on the 20-yard line with eighty yards-to-go, and is given four darts and forty-five seconds on a possession clock in which to use the darts to score or achieve a first down. A field goal can be attempted on any down in the present invention (if the drat throwing player has advanced the ball thirty yards or less from the scoring goal line), but then the players must switch end zones. If the dart throwing player in the present invention achieves a first down before the set time (preferably 25 seconds, 35 second, or 45 seconds) on the possession clock has elapsed, he or she can continue with an identical time interval and four more darts as many times successively as a first down is achieved within the pre-set maximum time interval allowed for possession. When the dart throwing player of the present invention has moved the ball down the field a total of eighty yards to reach the goal line of the opponent's end zone (the player's scoring end zone), touch down points will be awarded to the dart throwing player. The dart throwing player is then allowed a maximum of fifteen seconds to attempt an extra point after touchdown by throwing one dart toward the upper goal post. His or her turn then ends. In the alternative, the dart throwing player in the present invention can attempt a punt or a field goal (if close enough), after which his or her turn ends whether or not the attempt was successful. In contrast, during play of the Tesa game, players start with the ball on their own 40-yard line, and each throw of a dart must result in at least a 10-yard gain or forfeit possession of the ball (whereas in the present invention the minimum ten yard gain needed by a player to continue his or her turn can be achieved through the use of as many as four darts). Therefore, at any time in the Tesa game (except for the last ten yards to the goal line where the rules change to increase the difficulty in getting a touchdown) where ten or more yards has not been obtained in a single throw of a dart, the opponent takes possession of the ball at its current location. Another major difference between present invention and the Tesa invention is that in the present invention players can selectively target different areas on its entire simulated football field (between the two goal lines) which can result in a yard gain, a yard loss, a penalty (with loss of yards and loss of down), or a loss of ball possession via a fumble or interception. Furthermore, with the exception of the larger (double-wide) 20-yard central area spanning both sides of the 50-yard line that awards a player with a 5-yard gain each time a dart lands there, other scoring areas on the simulated football field of the present invention award higher yard gains but have closely adjacent areas with the potential for yards loss or loss of ball possession, including the highest scoring areas (in yards gained) that can be optionally located during game board manufacture in the end zones and are typically encircled by a significantly larger interception area. In contrast, in the Tesa invention, players aim darts at a centrally-located circular dart board covering the middle portion of its simulated football field, with the dart board having twenty pie-shaped areas each individually numbered with a different non-consecutive number from 1-20. Thus, when a player's dart hits eleven of the pie-shaped areas (those numbered 10-20), the player will be awarded with the ten yards needed to throw another dart and have the opportunity to move the total of fifty yards needed to reach the 10-yard line, after which the advancement rules change. In the present invention, the advancement rules do not change close to its goal line. Further Tesa differences from the present invention include the need for players to hit the pie-shaped areas with the number "1" or "20" to obtain an extra point after a touchdown (whereas in the present invention a dart is thrown toward the smaller goal post in the lower end zone), the pie-shaped areas with the number "1" or "20" must be hit to obtain a field goal but this can occur only within 60 yards of the scoring goal line (in contrast, the present invention field goals can only be attempted within 30 yards of the scoring goal line), a bull's-eye area on the circular dart board centrally between all of the pie-shaped areas when hit allows an automatic touchdown (while no such "automatic touchdown" feature is a part of the present invention), and a punt is calculated by doubling the number on the pie-shaped area hit by a dart (whereas a punt in the present invention involves a player throwing a dart to a position on the simulated field of the game board that is as far as possible from the opponent's scoring goal, with the ball being automatically forwarded to the nearest 5-yard line by the scoring/control board. During a punt in the present invention the scoring areas on the game board are not taken into consideration to determine the resulting ball location.

Another dart game with a football theme is U.S. Pat. No. 4,681,325 to Sheem (1987) which displays offensive and defensive targets on a simulated football field. Thus, as explained in column 5, lines 15-31 of the Sheem disclosure, the offensive team would throw a dart and perhaps gain 5 yards, which could be immediately countered by a dart throw by the defensive team that landed on an area marked as a "5-yard run attempt block", "fumble", or "interception". In contrast, the present invention concentrates on developing good offensive strategy, such as conservatively moving the ball down the field toward the scoring goal line via darts thrown near the 50-yard line to consistently receive first downs via smaller five-yard gains, without anyone able to nullify all or part of your action. Also, the pace of the Sheem game is slow, while that of the present invention can be as fast as the dart throwing player desires, according to the level of his or her dart throwing skill, experience, and time remaining on the game clock or possession clock, and further the ball movement in the two games is also not the same. In addition, the entire simulated football field in the present invention between its two goal lines is a target that affects either ball possession or the position of the ball on the field. Further differences between the present invention and the Sheem invention are that field goals in the present invention are scored by landing a dart within the rectangular perimeter of the smaller goal post in the lower end zone, and the center of the game board on the present invention has a double-wide area of low-value yard gain (5-yards) which also adds to the strategy of game play. No other dart game with a football theme is known to have a game board, scoring/control board, hand-held remote control device, or offensive play strategy that is the same or similar to that of the present invention, or provides all of its advantages.

BRIEF SUMMARY OF THE INVENTION

The primary object of this invention to provide a dart game with a football theme that allows the players to control and closely simulate the offensive and defensive strategies of a game of football. It is also an object of this invention to provide an electronic dart football game with a main computer chip that automatically turns ball possession over to the other team after interceptions, missed field goals, punts, and touch backs. Another object of this invention is to provide an electronic dart football game with information relating to game play prominently displayed for easy player and referee viewing. It is a further object of this invention to provide an electronic dart football game with a hand-held remote control device that allows players or a referee to automatically set modes (such as a field goal attempt), but which is automatically overridden by a main computer chip if the mode selected is inappropriate to the sequence of play. It is also an object of this invention to provide an electronic dart football game with a main computer chip that promptly scores the dart after it makes contact with the game board and includes automatic movement of the ball up and down the field. Another object of this invention is to provide an electronic dart football game that automatically gives an opponent two points should a player as a result of yard losses move backwards past his own goal line.

The present invention, when properly made and used, will provide a dart game with a football theme that is for individual players or teams. Each player throwing a dart continues to control the game, until scoring or a loss of possession event occurs (typically interception, fumble, missed field goal, punt, or touch back). All the opposing player or team can do during this time is wait for a change in possession and hope that ball position at that time is favorable, as there is no defensive move that can be made to "undo" all or part of the yard gains made by the dart throwing player. The frequency of rotation of players on a team can be decided in advance of the first dart throw, and, depending upon the number of players on a team, rotation may occur any time the team wants to make a player substitution, after each first down, after each scoring event, or when a new quarter begins. A referee is also selected by the players or teams to resolve disputes during the course of a game, such as the amount of yards won or lost when a portion of a dart lands on a line should the game board ever be used without an electronic scoring/control board. The game board used as a target for darts is similar in look and proportion to an actual football field, with a large central area between two goal lines having multiple 10-yard line markings, and the central area bounded by two opposing end zones each having a centered goal post. The game board is also vertically-oriented so that the players have a view of the field similar to that of a player in a regulation game of football. The goal post in the upper end zone is larger and used for extra point attempts after a touchdown, and the goal post in the lower end zone is smaller and used for field goal attempts. When a dart lands within any of the marked 10-yard spaces in the central area of the field, the gain or loss of yards clearly designated for that space is awarded to the player throwing the dart. Should a majority of a dart land in one of the football shapes located within a 10-yard space, the outcome for the player throwing the dart will be different from that otherwise designated for the 10-yard space. For example without any intended limitation, a football-shaped area may designate that 15 yards are awarded for a completed pass, or it may designate that the player throwing the dart loses possession of the ball via a fumble or interception. In the most preferred embodiment of the present invention game board, although not limited thereto, at least one additional space may also be marked in each end zone through which a player may score a high-value yard gain as a result of a pass completion. However, to increase the challenge for players, it is preferred that each of these high-value yard gain pass completion areas be surrounded with a substantially larger interception area by which the player would lose possession of the ball. Also, it is contemplated for the game board of the most preferred embodiment of the present invention to have six penalty areas each in the form of a referee spaced throughout the game board, which would cause the player to lose yards and incur a loss of down. Two of these penalty areas are preferably located in the double-wide space surrounding the 50-yard line where a five yard gain is otherwise awarded, while the other four penalty areas are positioned in the end zones in the most preferred embodiment of the present invention. Although the amount of yards lost as a result of players hitting a penalty area is the same for all referee-shaped penalty areas in the most preferred embodiment of the present invention, different embodiments of the present invention game can have penalty areas with at least two different yard loss values, as needed to facilitate novice players or in the alternative to raise the skill level required for game play to keep more experienced players challenged. Also, the football and referee configurations shown herein are merely representative of scoring and penalty areas that could be used in the most preferred embodiment of the present invention and are not intended to be used in strictly defining the scope of the present invention. Also, even though all of the football configurations shown herein closely resemble one another in size and all six of the referee configurations shown herein are approximately the same size, differing sizes of each could be used on the same game board and/or in different embodiments of the present invention. Thus, it is contemplated for the scoring and penalty areas on the present invention game board to include different graphics, positioning, numbers, sizes, size variations, arrangements, and representations from those shown and described herein, such as but not limited to the use of multiple penalty areas in the shape of referees that are each signaling a different type of penalty in regulation football (such as defensive holding, illegal facemask, unnecessary roughness, off-sides, and the like), several of which may have a differing yard loss value from the others.

Before game play commences, the game board is preferably hung with the scoring/control board above it, where the scoring/control board is put out of reach of most bad throws. The scoring/control board is also electronically connected to the game board for communication between the main computer chip within the scoring/control board and the game board. Players typically stand approximately nine feet in front of the game board to throw darts. Furthermore, a hand-held remote control device is electronically connected to the scoring/control board, for use by players before a punt or field goal attempt, and by a referee to assess a penalty, such as for a personal foul or loss of down (such as, but not limited to, when the dart of a throwing player completely missed the game board). The center of the game board (between the two 40-yard lines) is a large (double-wide) area offering a 5-yard gain, giving good players an opportunity to control game play when time is running low (just as the pros do when they have the lead and want to run down the clock). The main computer control chip of the timing and scoring/control board maintains all aspects of the game in sequence once play begins (when the first dart hits the game board). Deciding who will throw first and which goal they will defend, can be decided by conventional means, such as a coin toss. The first player in the game is given four darts and considered first-and-ten on the 20-yard line, with 80 yards-to-go to reach the opponent's goal line and score a touchdown, which can be accomplished by hitting yard gain areas with a dart or those areas marked as a pass completion. Successive first downs are needed to remain in possession of the ball, as in a regulation football game. Furthermore the dart throwing player is permitted a maximum possession time interval (preferably 25 second, 35 seconds, or 45 seconds) to achieve a first down by throwing one or more of the four darts in his or her possession (a departure from regulation football). If a first down is not achieved as a result of throwing four darts, or the four darts are not all thrown within the allotted possession time interval, the opposing player or team will take over at the current location of the ball, as in regulation football. When each subsequent first down is achieved, the dart throwing player is given four darts (and another possession clock time interval) with which to continue play and attempt to score or achieve another first down. On a fourth down, if the player throwing darts wants to punt, the button on the hand-held remote control device displaying the word "punt" must be activated prior to throwing a dart. After the "punting" dart is thrown as far down the field as possible away from the opponent's scoring goal, the opposing player or team then starts first-and-ten from the closest five yard line forward of the position where the "punting" dart lands. The scoring/control board automatically establishes the ball position for the players. Punting can only occur on third and fourth downs, and the "fumble" and "interference" areas that are otherwise applicable when a dart is thrown do not affect the outcome of the "punting" throw. Furthermore, there is no switching of end zones after a punt. In contrast, a field goal can only be attempted when a player is on the 30-yard line, or closer, to his or her scoring goal, and prior to throwing a "field goal" dart the player must activate the button on the hand-held remote control device displaying the word "field goal". A field goal may be attempted on any down, and the "field goal" dart must hit the game board substantially inside the small rectangular perimeter of the lower goal post. If it lands on the center of the goal post, or outside it, the field goal is considered as "missed", and the opponent begins play first-and-ten at the site of the field goal attempt. If the field goal is successful, the dart throwing player receives three points and the end zones are switched so that the opponent then begins play first-and-ten on the opposite 20-yard line with 80 yards-to-go to score. The scoring/control board will automatically make the needed end zone and ball positioning adjustments. Any time a dart lands partially on a line and partially in a scoring area so that the outcome is uncertain, the referee will decide the outcome. After a touchdown, the player scoring it is typically awarded six points, and is given 15 seconds in which to gain an extra point by throwing one dart toward the larger goal post in the upper end zone. If the time period of 15 seconds is exceeded, the extra point is considered "missed", and the additional point forfeited. An option for a two-point conversion is also possible, and considered within the scope of the present invention. There are four quarters in a present invention game, each of which is preferably five, ten, or fifteen minutes in length. No player can stop the clock, only the referee can.

The description herein provides preferred embodiments of the present invention but should not be construed as limiting its scope. For example, variations in the length and width dimensions of the LED screens used in the scoring/control board; the size, type, and location of the information provided on the LED screens incorporated as a part of the scoring/control board; the number and positioning of marked spaces on the game board awarding a yard gain to players; the number and positioning of marked spaces on the game board awarding a yard loss to players; the number and positioning of marked spaces on the game board giving players a penalty, such as loss of down and/or loss of ball possession; whether there is size variation in similarly configured scoring areas; whether there is size variation in similarly configured penalty areas; and the means of mounting the scoring/control board in a location adjacent to the present invention game board where it will be easily viewed by players and the referee, other than those shown and described herein, may be incorporated into the present invention. Thus, the scope of the present invention should be determined by the appended claims and their legal equivalents, rather than being limited to the examples given.

COMPONENT LIST

Figure 1:
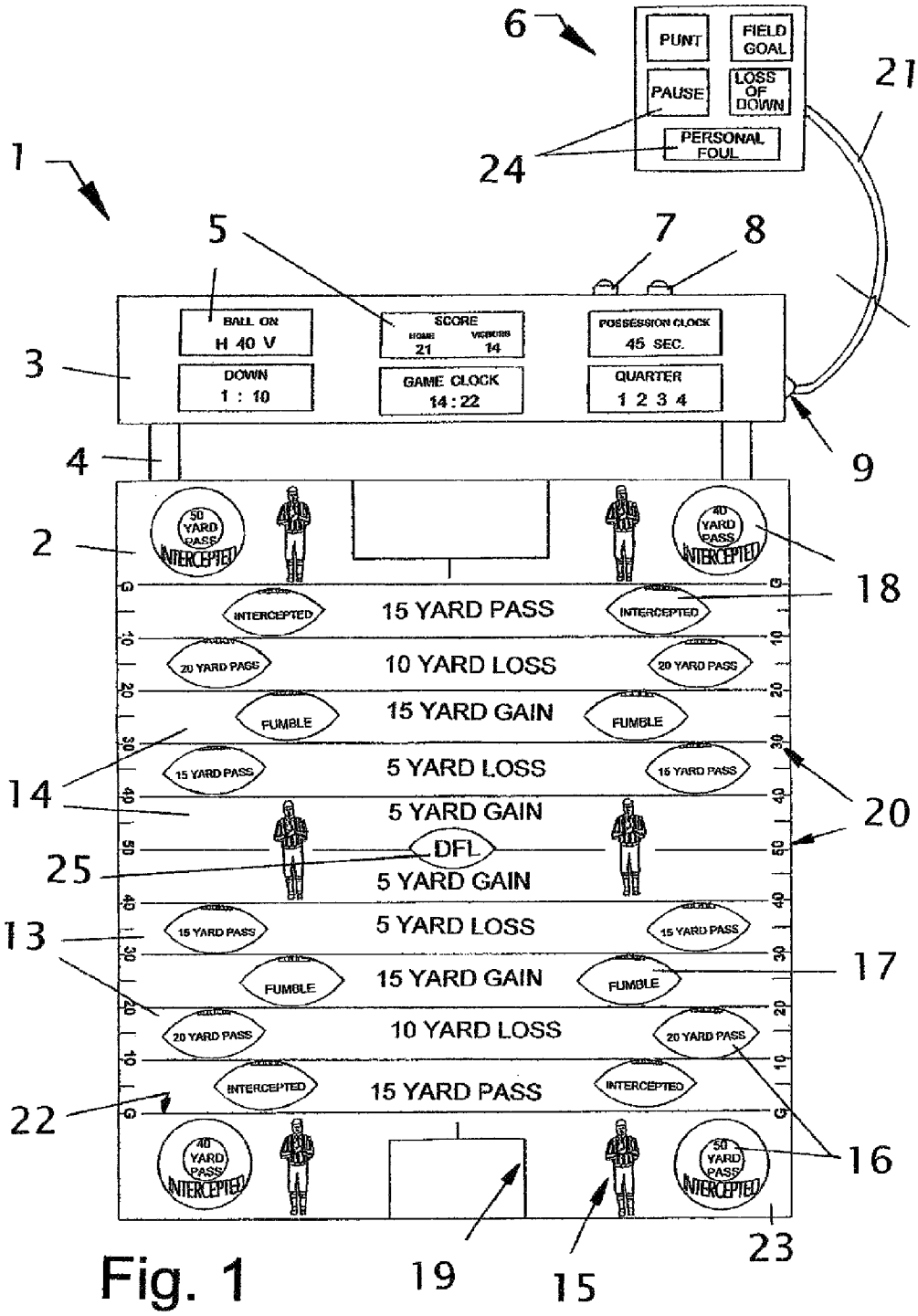
FIG. 1 is a front view of the most preferred embodiment of the present invention game board and scoring/control board connected to one another and having a hand-held remote control device connected to the scoring/control board that can be used by a player or referee.

1—electronic dart football game
2—game board
3—scoring/control board
4—mounting bracket
5—LED screen
6—hand-held remote control device
7—game clock set button
8—possession clock set button
9—port for connection of remote control 6 to scoring/control board 3
10—cable for connection of game board 2 to scoring/control board 3
11—main computer control chip
12—electrical wiring extending between control chip 11 and LED screens 5
13—area between adjacent 10-yard lines indicating loss of yards as a result of a running play
14—area between adjacent 10-yard lines indicating gain of yards as a result of a running play
15—referee-shaped area indicating penalty that can include loss of yards and/or loss of down
16—football-shaped or circular area indicating gain of yards via passing
17—football-shaped area indicating loss of ball possession as a result of a fumble
18—football-shaped or circular area indicating loss of ball possession as a result of an interception
19—goal post
20—yard line numerical marking
21—cable for connection of hand-held remote control 6 to scoring/control board 3
22—goal line
23—end zone
24—remote control button
25—logo

DETAILED DESCRIPTION OF THE INVENTION

Figure 2:
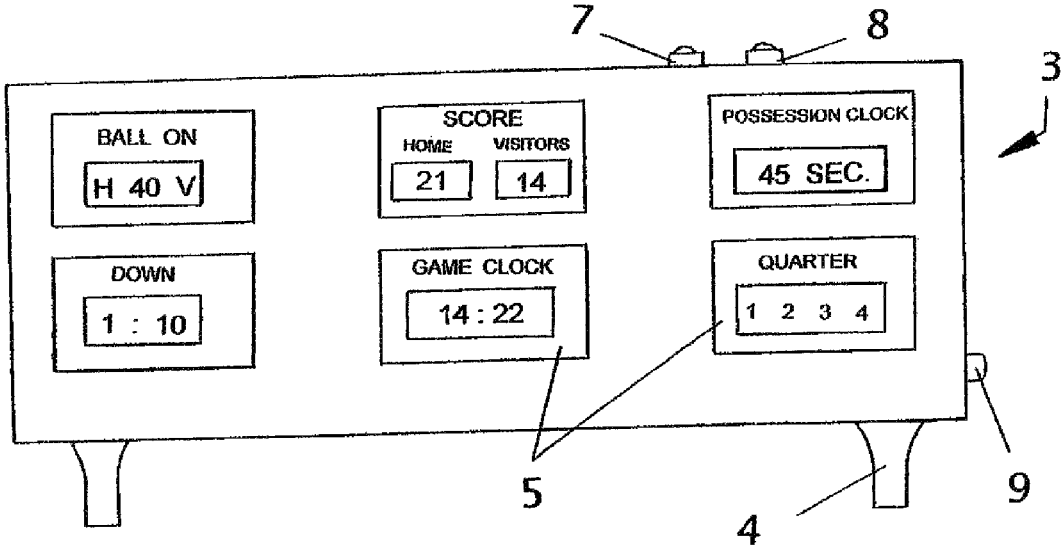
FIG. 2 is an enlarged front view of the scoring/control board preferably used as a part of the most preferred embodiment of the present invention.
Figure 3:
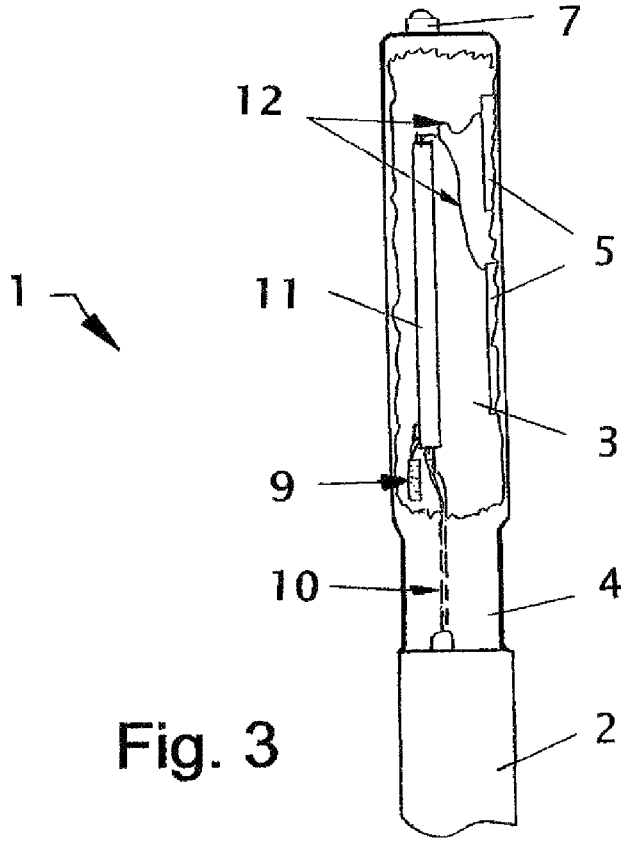
FIG. 3 is a sectional view of the scoring/control board in the most preferred embodiment of the present invention that reveals the main computer chip and its connection to the LED screens.

FIGS. 1-3 provide illustrations of an electronic dart football game that allows players to control and more closely simulate the offensive and defensive strategies of a game of football when compared to other dart games with a football theme. Thus, each time it is a player's or team's turn to throw darts, play can be conservative (such as by consistently targeting scoring areas on the simulated football field having smaller yard gains and less associated risk), without the opportunity for opponents to nullify all or part of the action taken. While FIG. 1 shows the most preferred embodiment of the present invention game board 2 and scoring/control board 3 connected to one another, with a hand-held remote control device 6 connected to the scoring/control board 3, FIG. 2 shows only the scoring/control board 3 and FIG. 3 shows a sectional view of the cable/wiring (10 and 12) connected respectively between the present invention game board 2 and scoring/control board 3, as well as between the main control computer chip 11 within the scoring/control board 3 and two of the LED screens 5. None of the illustrations provided herein is completely to scale, and measurements taken therein should not be used to impose any limitation in the scope of the present invention. One example of an out-of-proportion feature in FIG. 1 is the relatively large and unrealistic size of the hand-held remote control device 6 as compared to the perimeter dimensions of the game board 2 and scoring/control board 3 shown in FIG. 1. During manufacture, the game board 2 and scoring/control board 3 would be made proportionally larger relative to hand-held remote control device 6 than is shown in FIG. 1. Furthermore, the number, location, size, appearance, and replication of scoring areas (16-18) present on the simulated football field of the most preferred embodiment of the present invention discussed herein can vary from that shown in FIG. 1, without departing from the spirit and objectives of the present invention. In addition, the number, size, appearance, content, and positioning of the LED screens used as a part of the scoring/control board 3 may also vary from that shown in FIGS. 1-3. Thus, the scope of the present invention should be determined by the appended claims and their legal equivalents, rather than being limited to the examples provided.

FIG. 1 shows the most preferred embodiment of the present invention having a game board 2 closely resembling a regulation football field with opposing end zones 23, a goal post 19 centrally positioned within each end zone 23, and consecutive yard line markings "10", "20", "30", and "40" extending between each goal line 22 and a centrally marked 50-yard line. A centrally placed logo 25 positioned on the 50-yard line is also reminiscent of a regulation football field (not shown) and preferred. If logo 25 is hit, it will be counted as a 5-yard gain, similar to the gain awarded for a dart hitting its immediate surroundings. In addition, the game board 3 of the most preferred embodiment of the present invention is shown in FIG. 1 to have six referee penalty areas 15, with two referee penalty areas 15 positioned mid-field on the 50-yard line and two referee penalty areas 15 positioned within each end zone 23. It is contemplated in the most preferred embodiment of the present invention that if a player hits one of the referee penalty areas 15 with a dart, that player will immediately incur a loss of ten yards and a loss of down. Also in the most preferred embodiment of the present invention, all of the referee penalty areas 15 would have a similar appearance and result in the same penalty. However, this is not critical to the present invention and other embodiments, such as one for advanced players, might have more than six referee penalty areas 15, each referee penalty area 15 might be visually different from the others and displaying the arm and/or other body part configuration corresponding to a distinct regulation football penalty (off-sides, holding, facemask, unnecessary roughness, etc.), and/or several of the referee penalty areas 15 might have a differing yard loss value from the others. It is also contemplated for the game board 3 of the most preferred embodiment of the present invention shown in FIG. 1 to have multiple football-shaped areas (such as those marked by the numbers 16-18) that impose a different outcome when hit by a dart than the areas immediately surrounding them, such as a yard loss instead of a yard gain, a yard gain instead of a yard loss, or a loss of ball possession due to a fumble or interception. Size variation among the football-shaped areas (16-18), and the referee penalty areas 15, on the same present invention game board 2 can occur, although not shown in FIG. 1. Scoring areas with higher value yard losses are strategically placed near scoring areas providing higher value yard gains. Furthermore, more of the football-shaped areas 17 that are marked to indicate a fumble than are shown in FIG. 1, and more of those marked with the number 18 to indicate an interception than are shown in FIG. 1, may be used when the present invention is intended for players with advanced dart-throwing skills. One additional feature displayed on the game board 3 of the most preferred embodiment of the present invention and shown in FIG. 1, comprises four high-value-pass-completion/interception areas 16/18 positioned adjacent to the corners of the two end zones 23. Such high-value areas 16/18 may be optionally added, according to player skill or experience. Although they provide a high-value yard gain, each pass completion area 16 is encircled by a substantially larger interception area 18 that increases a player's risk in selecting such a target for a dart throw. However, the reward is great if the game clock is running out of time and a player is behind in the score. It should be noted that the number, size, size variation, location, and appearance of football-shaped areas 16-18 positioned between the goal lines 22 and the high-value-pass-completion/interception areas 16/18 positioned within the corners of the two end zones 23 can be different from that shown in FIG. 1 without departing from the spirit and objectives of the present invention.

FIG. 1 also shows the game board 2 in a vertically-extending position with one goal post 19 positioned above the other, as is preferred during game play since a person throwing the darts then has a visual sense of moving up and down the field, providing another similarity to regulation football. Also, in the most preferred embodiment of the present invention darts are thrown by players positioned approximately nine feet from game board 2. FIG. 1 further shows scoring/control board 3 located above game board 2, in a position that puts scoring/control board 3 out of reach of most bad throws, with two mounting members 4 connecting scoring/control board 3 to game board 2. The size, location, appearance, and number of mounting members 4 are not critical, and can be varied from that shown in FIGS. 1 and 3. In the most preferred embodiment of the present invention the mounting members 4 provide stabilization for the mounting of the smaller scoring/control board 3 against a vertically-extending support surface (not shown), as well as a means of protectively housing the cable 10 that provides electronic communication between game board 2 and scoring/control board 3 (see FIG. 3). Mounting members 4 can be independent from game board 2 and scoring/control board 3, associated with scoring/control board 3, or all three components can be manufactured together. The main consideration in using mounting members 4 is to increase the physical location of scoring/control board 3 away from game board 2 to reduce the dart contact damage on the LED screen or screens 5. In addition, FIG. 1 shows scoring/control board 3 having a port 9 on one of its sides, and a hand-held remote control device 6 connected to the port 9 via electronic cable 21. In the alternative, although not shown, it is contemplated for remote control device 6 to be a wireless remote. Furthermore, although a remote control device 6 is preferred for safety reasons so as to reduce the likelihood of injury from a thrown dart, all of the control features on hand-held remote control device 6 can in the alternative be incorporated into game board 2 and/or scoring/control board 3. The location of port 9 relative to scoring/control board 3 is not critical, although positioning for port 9 is preferred when it minimizes the amount of wiring and/or cable used within scoring/control board 3 for connection of internal components. FIGS. 2 and 3 both show a preferred positioning and content for LED screens 5, which is not considered critical as long as the information displayed on them can be clearly and promptly viewed by the players and referee during a game. Aesthetic enhancement of LED screens 5 and/or scoring/control board 3 is also considered within the scope of the present invention, although not shown. FIGS. 1 and 2 show the preferred content for LED screens 5 in the most preferred embodiment of the present invention, which includes a game clock that displays time remaining in the game, a possession clock that shows players and the referee how much of pre-set time interval of possession allowed for additional play after a first down still remains, an area that shows the home team score in close proximity to the visitors score, an area that shows the current location of the ball on the simulated football field, an area that shows the period of play (whether $1^{st}$, $2^{nd}$, $3^{rd}$, or $4^{th}$ quarter), and an area that shows the down being played and the yards-to-go to make a first down (such as $1^{st}$ and 10, $2^{nd}$ and 5, $2^{nd}$ and 15, $4^{th}$ and 1, etc.). It is not critical that the information displayed on LED screens 5 is shown in the exact order, or with the same visual appearance shown in FIGS. 1 and 2, as long as the information presented is easily viewed by the players and referee. Also, although not shown, a directional arrow can be added to area that shows the current location of the ball on the simulated football field to visually assist players. This also applies to the "punt", "field goal", "pause", "loss of down", and "personal foul" buttons 24 on hand-held remote control device 6, and it is not critical for the exact order and visual appearance of buttons 24 to be the same as that shown in FIG. 1. The set button 7 shown in FIGS. 1-3 on the top of scoring/control board 3 is for setting the preferred time interval to be used for each quarter of a present invention game (preferably five, ten, or fifteen minutes), with that time interval being displayed initially on the game clock at the beginning of each quarter. In contrast, the set button 8 shown in FIGS. 1-2 on the top of scoring/control board 3 is for setting the preferred maximum time interval to be used by a dart throwing player to score or make a first down (preferably 25 seconds, 35 seconds, or 45 seconds), with that time interval being restored on the possession clock immediately after a first down is made. Set buttons 7 and 8 should be sufficiently large for easy activation. Furthermore, the mounting of game board 2 and scoring/control board 3 against a vertically-extending surface should not place set buttons 7 and 8 out of easy reach of the person selected by the players as referee. Since FIG. 3 is a sectional view, it is able to show the main computer control chip 11 positioned within the most preferred embodiment of the scoring/control board 3, as well as the cable 10 connected between control chip 11 and LED screen 5 and the wiring 13 connected between control chip 11 and game board 2. One preferred positioning for a port 9 used for the connection of a hand-held remote control device 6 is also visible in FIG. 3. Typically, the referee would hold the hand-held remote control device 6 during a game, so that pausing of the game clock and possession clock can promptly occur via the remote "pause" button 24 when needed, such as, but not limited to, for discussion regarding the assessment of a penalty when an act of interference directed toward the dart throwing player, cheating, and/or other form of personal foul is observed. When players announce the desire to punt or attempt a field goal, the player or the referee can activate the "punt" or "field goal" button 24 so that control chip 11 will take the appropriate scoring action after the next dart is thrown.

As mentioned before in part, but with added detail, a summary of the present invention and its options ensues. The electronic dart football game of the present invention is for individual players or teams. The game board 2 used for the game is similar in proportion to an actual football field, with a large central area having multiple 10-yard line markings 20 that is bounded by two opposing end zones 23 each having a centered goal post 19. The upper goal post 19 is used for extra point attempts after a touchdown, and is larger than the lower goal post 19 below it that is used for field goal attempts. When a thrown dart lands within any of the spaces (13 or 14) bounded by two adjacent 10-yard line markings 20, the gain or loss of yards clearly designated for that space (13 or 14) is awarded to the player throwing the dart and the scoring/control board 3 moves a game ball the corresponding amount. For example, FIG. 1, shows the two spaces on game board 2 between the 30-yard line and the 40-yard line (one each on opposing sides of the 50-yard line) awarding a five-yard loss to the dart throwing player should either one of them be hit with a dart. Should the majority of a dart land in one of the football shapes (16-18) located within a 10-yard space (13 or 14), the outcome for the player throwing the dart will be different from the gain or loss of yards designated for that 10-yard space (13 or 14). For example, yards may be attained for a completed pass (see football-shaped spaces marked with the number 16), or the player throwing the dart could lose possession of the ball via a fumble (see football-shaped spaces marked with the number 17) or interception (see football-shaped spaces marked with the number 18). Before game play commences, the game board 3 is hung so that the top edge adjacent to its large upper end zone 23 is approximately five feet and ten inches above the floor or other ground surface (not shown) upon which the players will stand to throw their darts. The scoring/control board 3 electronically connected to game board 2 is preferably mounted above game board 2 to be easily visible and out of the way of most bad throws, but not limited thereto. Also, a hand-held remote control device 6 is electronically connected to the scoring/control board 3, for use by players before a punt or field goal attempt, and by a referee to pause the game when needed, and to assess penalties, such as for a personal foul. All areas of game board 3 between the goal lines 22 are used for scoring, either in the form of yard gains or losses, except a few football-shaped areas (17 and 18) that are designated as "intercepted" or "fumble", and two referee penalty areas 15 which impose a penalty in the most preferred embodiment of the present invention that results in a loss of ten yards and also a loss of down. Two additional referee penalty areas 15 are located in each end zone 23, one on each side of the approximately centered goal post 19, which in the most preferred embodiment of the present invention result in the same penalties if a player hits them with a dart. The center of game board 2 (between the two 40-yard lines) is a large (double-wide) area offering a 5-yard gain, giving good players an opportunity to control game play when time is running low (just as the pros do in a regulation game when they have the lead and want to run down the game clock). The smaller timing and scoring/control board 3 which has a main computer control chip 11 that coordinates the game board 2 and scoring/control board 3, and also maintains all aspects of the game in sequence once play begins, is typically hung approximately four inches above game board 2 to put it out of reach of most bad throws. Also before game play commences, the players must agree on a person who will perform the duties of a referee, and further agree to abide by the decisions made by the referee, which are final. In addition before starting a game, the players must decide who will throw first and/or which end zone they will defend, which can be decided by a coin toss. The first player is given four darts and is considered first-and-ten on the 20-yard line, with 80 yards-to-go to score. Play commences when the first dart thrown makes contact with game board 3. A maximum possession time interval (preferably twenty-five seconds, thirty-five seconds, or forty-five seconds) is agreed to by the players and referee in advance of throwing the first dart, and the set button 8 on top of scoring/control board 3 is used to select the proper time interval via depressing, turning, and/or offsetting at an angle the set button 8. The amount of time allowed for each quarter (preferably five, ten, or fifteen minutes) is also agreed to by the players and referee in advance of throwing the first dart, and the set button 7 on top of scoring/control board 3 is used to select the proper time interval via depressing, turning, and/or offsetting at an angle the set button 7. Once game play commences, scoring/control board 3 automatically sets subsequent possession and quarter time intervals when needed, so that set buttons 7 and 8 are only needed routinely at the beginning of a present invention game. If a first down is not achieved as a result of a player throwing the four darts in his or her possession, or does not throw them within the allotted possession time interval so that the possession time interval expires, the opponent will take over at the current location of the ball. To continue playing, the player throwing darts must score (attain sufficient yards to move to or beyond goal line 22 or successfully achieve a field goal), or at a minimum gain ten yards and receive another first down, as in regulation football. When a first down is achieved, the player is given a total of four darts with which to continue play and attempt to score or receive another first down. On a fourth down, if the player throwing darts wants to punt, the button 24 on the hand-held remote control device displaying the word "punt" must be activated prior to throwing a dart. This can be done by the player or the referee. The next dart is then thrown as far down the field away from the opponent's goal as possible, and if any football-shaped scoring area (16-18) is hit, the action indicated therein does not apply. The opposing player then starts first-and-ten from the closest five yard line forward of the position where the "punting" dart lands. Punting can occur only on third and fourth downs. A field goal can only be attempted when a player is on the 30-yard line, or closer, to his or her scoring goal. When a player throwing darts wants to attempt a field goal, prior to throwing the next dart ("field goal" dart) the player must activate the button 24 on the hand-held remote control device 6 displaying the word "field goal", or state the words "field goal" so that the referee activates the "field goal" button 24. A field goal may be attempted on any down. In the most preferred embodiment of the present invention, the "field goal" dart must hit the game board completely inside the rectangular perimeter of smaller lower goal post 19. If it lands on goal post 19, or outside it, the field goal is considered as "missed", and the opponent begins play first-and-ten at the site of the field goal attempt. In other embodiments of the present invention prior to the commencement of game play, it can be decided by the players and referee that a field goal attempt will be considered successful as long as a "field goal" dart lands substantially within the rectangular perimeter of goal post 19. If the field goal is successful, the player receives three points and the end zones are switched so that the opponent then begins play first-and-ten on the opposite 20-yard line with 80 yards-to-go to score. Any time a dart lands partially on a line and partially in a scoring area so that the outcome is uncertain, the referee will decide the outcome. After a touchdown, when using the most preferred embodiment of the present invention, the player scoring it is awarded six points. A player need only gain sufficient yards to reach goal line 22, not necessarily go beyond it. An extra point in the most preferred embodiment of the present invention can be awarded if the scoring player throws one additional dart toward larger upper goal post 19 within 15 seconds of making the touchdown. If the "extra point" dart lands completely inside the rectangular area within upper goal post 19, the extra point would be awarded to a player. If the extra point attempt is not attempted within 15 seconds of the touchdown, then the extra point is considered "missed", and forfeited. No hand-held remote control device button 24 would need to be activated prior to throwing the "extra point" dart, and only one attempt at collecting an extra point can be made within the 15-second time period allowed. An option for a two point conversion could be used some embodiments of the present invention, wherein a dart throw resulting in a yard gain of at least fifteen or twenty yards gain would be considered successful. The exact yards needed for success and award of the two extra points would be determined during manufacture of control chip 11. In the most preferred embodiment of the present invention a touch back will occur if a player crosses his or her own goal line 22 (just reaching the goal line 22 is not sufficient for an award of points to the other player or team). Once a touch back occurs, the opposing player or team receives 2 points is given possession of the ball at the 30-yard line with seventy yards-to-go. At the end of each of the four quarters in a present invention game, the players or teams switch end zones 23. Also, the player or team not throwing the first dart at the beginning of the first quarter, will throw the first dart at the beginning of the third quarter (as in regulation football). Furthermore, players are not given time-outs to stop the clock, and the game clock is not routinely stopped after a touchdown, punt, or penalty assessment, or when the players are engaged in any discussion or dispute. However, if time has ended and the player attempting to throw a dart was pushed or otherwise cheated out of an opportunity to throw the dart before the game clock or possession clock ran out, that player is allowed to finish the throw. Also, if there is any interference by one player against the other, the player attempting to throw a dart receives a first and goal on the 5-yard line, with the outcome of the next dart throw determining whether a touchdown is made. If a touchdown is not made, the opposing player or team takes possession of the ball on the same 5-yard line, with ninety-five yards-to-go. The interference for which a referee may call a personal foul may include, but is not limited to, a non-throwing player or any fan grabbing the throwing player's darts and placing them out-of-reach so that a throw cannot be completed before the time clock or possession clock runs out, pushing an opponent, standing in the way of a throwing player, throwing objects at an opponent, throwing objects at game board 2 or scoring/control board 3, and/or causing any type of distraction for the dart throwing player. The only times the game clock is stopped is after the end of a quarter, when it is reset by the scoring/control board 3. In the most preferred embodiment of the present invention a one minute time period is routinely allowed between quarters. Also, if a thrown dart lands exactly on the line, it is up to the referee to make the call. The player or team with the most points when the game clock runs out after the fourth quarter is the winner, as long as all penalty throws permitted after the game clock has run out have been completed. Use of game board 2 or other dart board substantially resembling it without scoring/control board 3 and hand-held remote control device 6 is possible, if manual scoring and timing are used. However, the pace of a manually-scored game is slower and generally less desirable than when scoring/control board 3 and hand-held remote control device 6 are present and the players need only to be concerned with game strategy. Furthermore, although not shown, to adapt the present invention for beginner or advanced play, scoring/control board 3 could be made with a plug-in port that would allow players to replace control chip 11 with another similar computer chip having modified rules that lessen or increase the strategy needed for game play. Complicated pre-programming of scoring/control board 3 to select rules that will be included during game play is not contemplated as a part of the present invention. Thus, the only set up for the players and referee in advance of the first dart throw toward game board 2 is that needed via set buttons 7 and 8 to respectively allow players to determine the time of each quarter and the possession time during which a player would need to make a first down, or score.

I claim:

1. An electronic dart football game that allows individual players and teams to control and closely simulate the offensive and defensive strategies of a game of football, said electronic dart football game comprising:

a game board configured for use as a target for darts and also having the appearance of a football field, said game board having a central scoring area extending between two opposed goal lines and consisting of the entirety of space between said two goal lines, said central scoring area being marked with areas providing yard gains, yard losses and ball possession losses, said game board also having an end zone adjacent to each of said goal lines that extends away from said central scoring area, a centered goal post within each of said end zones, one of said goal posts being larger than the other, said game board oriented during game play so that one of said end zones is positioned above the other to place the larger one of said goal posts above the smaller one of said goal posts, said central scoring area having a 50-yard line centrally between said goal lines and four horizontally-extending lines numerically marked to represent consecutive 10-yard increments between said 50-yard line and each of said opposed goal lines, including two 40-yard lines, the space in said central scoring area extending between said two 40-yard lines being configured as one enlarged scoring area marked to award a single low-value yard gain to a player throwing a dart that makes contact therein, said three horizontally-extending lines between each of said 40-yard lines and the one of said goal lines most adjacent thereto also defining four scoring areas collectively marked to award both yard gains and yard losses to a player throwing a dart that makes contact therein, said central scoring area additionally having at least one penalty area that causes a loss of down for a player; and said central scoring area also having a plurality of additional scoring areas each located within one of said eight scoring areas between said two 40-yard lines and the respective one of said two goal lines closest thereto, with the ones of said additional scoring areas marked to provide a yard gain being positioned within one of said eight scoring areas providing a yard loss, and the ones of said additional scoring areas marked to provide a loss of ball possession being positioned in one of said eight scoring areas providing a yard gain; and a control board housing a main computer control chip adapted to coordinate and maintain all aspects of a game of football in sequence once a first thrown dart makes contact with said game board, including control of said game board and electronic transmission of dart contact location information from said game board to said control board, and to further calculate and electronically provide game play and scoring information for visual display, said control board also housing at least one LED screen configured for visual display of at least a portion of said game play and scoring information, said control board also having a first electronic communication means adapted for connection between said control chip and said game board, a second electronic communication means adapted for connection between said control chip and said at least one LED screen, a first set button configured for use in establishing a player-selected time interval for each quarter of game play, and a second set button configured for use in establishing a player-selected maximum ball possession time length allowable for each player to throw at least one dart but no more than four darts at said game board, wherein after said first and said second set buttons are used respectively to establish said time intervals for said quarters of game play and player ball possession, and a first dart thrown by a player makes contact with said game board and activates said control board, said main computer control chip in said control board coordinates and maintain all aspects of a game of football in sequence, including said game play and scoring information visually displayed on said at least one LED screen.

2. The game of claim 1 further comprising a remote control device configured for being hand-held by an adult human hand and manual entry of a player's intention to make punts and field goal attempts in advance of a dart throw, wherein said control board also comprises an electronic communication port, and further comprising a third electronic communication means adapted for connection via said electronic communication port between said control chip within said control board and said remote control device.

3. The game of claim 2 wherein said remote control device is further configured for manual entry of personal fouls, loss of down, and a command to said control board to pause advancement of said time interval for the current quarter of game play and said time interval of player ball possession.

4. The game of claim 1 further comprising at least one high-value yard gain scoring area in at least one of said end zones.

5. The game of claim 4 further comprising an enlarged area marked for loss of ball possession around said at least one high-value yard gain scoring area.

6. The game of claim 1 wherein said at least one penalty area is selected from a group consisting of penalty areas configured as football referees, penalty areas marked to award a player a yard loss and a loss of down, penalty areas each having similar size and configuration to one another, penalty areas located in said enlarged scoring area adjacent to said 50-yard line that is marked to award a single low-value yard gain to a player throwing a dart against it, penalty areas located in said end zones, and penalty areas configured as football referees posed to display the body language signal for at least one type of penalty in a regulation football game.

7. The game of claim 1 wherein said additional scoring areas are selected from a group consisting of additional scoring areas configured as a football, additional scoring areas that award a player throwing a dart against it with a yard gain, additional scoring areas each having similar size and configuration to one another, and additional scoring areas that when hit with a dart result in a change of ball possession.

8. The game of claim 1 further comprising mounting means adapted for support of said control board by said game board when said control board is positioned above said game board.

9. The game of claim 8 wherein said mounting means is also configured for protectively housing said first electronic communication means adapted for connection between said control chip and said game board.

10. The game of claim 1 further comprising at least one logo positioned adjacent to said 50-yard line within said enlarged scoring area marked to award a single low-value yard gain to a player throwing a dart against it.

11. The game of claim 1 wherein said game play and scoring information for visual display on said at least one LED screen is selected from a group consisting of the number of quarters in a game, which of said quarters is currently being played, how much time remains in said player-selected time interval for said quarter currently being played, how much time remains in said player-selected time interval of ball possession, cumulative home team point score, cumulative visitors point score, current yard line location with respect to said goal line for the player throwing darts, and which of the four darts allowed to be thrown during said time interval of ball possession is currently being played and how many yards are currently needed to advance the player a minimum of ten yards to make said first down before said time interval of ball possession has elapsed.

12. The game of claim 1 wherein said game board further comprises additional horizontally-extending lines positioned between said goal lines that are numerically marked to represent 5-yard increments, with at least one of said additional horizontally-extending lines being centrally located between every two adjacent ones of said horizontally-extending lines numerically marked to represent consecutive 10-yard increments, and further with at least one of said additional horizontally-extending lines being centrally located between each of said goal lines and the next adjacent one of said horizontally-extending lines numerically marked to represent a 10-yard increment.

13. A method for using the electronic dart football game of claim 1 that allows individual players and teams to control and closely simulate the offensive and defensive strategies of a game of football, said method comprising the steps of:

(a) providing at least two players, at least four darts, and said electronic dart football game of claim 1;

(b) orienting said game board into a vertically-extending position with said larger goal post above said smaller goal post;

(c) positioning said control board above said game board;

(d) electronically connecting said control board to said game board;

(e) said players using said first and second set buttons to select said maximum time interval for each of said quarters of game play and said maximum time interval for player ball possession;

(f) said players selecting a first player to throw said darts and one of said end zones to initially use for advancement;

(g) said first player throwing a first one of said darts at said game board to activate said control board, said first player making said first throw from a 20-yard line with 80 yards-to-go to reach said goal line adjacent to the one of said end zones initially selected for advancement;

(h) said first player throwing up to four of said at least four darts within said maximum time interval for player ball possession;

(i) when said up to four darts are thrown and said first player achieves at least a 10-yard gain within said maximum time interval for player ball possession, said control board awarding said first player another maximum time interval for player ball possession to throw up to four more darts;

(j) when said up to four darts are thrown and said first player does not achieve a 10-yard gain and does not punt using said third or fourth dart, said control board turning ball possession over to a next one of said players at the current location of game play;

(k) when said first player does not achieve a first down and punts by throwing the third or fourth one of said four darts toward said game board after communicating an intention to punt to said control board, said control board turning ball possession over to a next one of said players;

(l) when said first player is thirty yards and closer to the one of said end zones initially selected for advancement and said first player attempts a field goal by throwing any one of said four darts toward said lower goal post on said game board after communicating an intention to make a field goal attempt to said control board, if said field goal dart makes contact with said game board within said lower goal post, said control board awarding three points to said first player, switching end zones for said players, and turning ball possession over to a next one of said players at the 30-yard line with 70-yards-to-go to reach said goal line adjacent to the one of said new end zone selected by said control board for advancement, with said next player starting with four of said at least four darts and said maximum time interval for player ball possession in which to use as many of said four darts as is needed to achieve a 10-yard gain;

(m) when said first player is thirty yards and closer to the one of said end zones initially selected for advancement and said first player attempts a field goal by throwing any one of said four darts toward said lower goal post on said game board after communicating an intention to make a field goal attempt to said control board, if said field goal dart does not make contact with said game board within said lower goal post, said control board switching turning ball possession over to a next one of said players at the location of said field goal attempt, with said next player starting with four of said at least four darts and said maximum time interval for player ball possession in which to use as many of said four darts as is needed to achieve a 10-yard gain;

(n) when said up to four darts are thrown and said first player achieves at least a 10-yard gain within said maximum time interval for player ball possession, and said first player successively achieves at least a 10-yard gain within said maximum time interval for player ball possession until said first player reaches said goal line of said initially selected end zone for advancement said control board awarding six points to said first player, said control board also allowing said first player a time period of fifteen seconds to throw a bonus point dart toward said upper goal post on said game board and awarding one bonus point to said first player if said bonus dart make contact with said game board within said goal post, said control board also turning ball possession over to a next one of said players at the 20-yard line with 80-yards-to-go to reach said goal line adjacent to the one of said new end zone selected by said control board for advancement, with said next player starting with four of said at least four darts and said maximum time interval for player ball possession in which to use as many of said four darts as is needed to achieve a 10-yard gain;

(o) when any one of said up to four darts is thrown and said first player achieves a yard loss placing said first player back behind the one of said goal lines associates with said end zone not initially selected for advancement to generate a touchback, said control board turning ball possession over to a next one of said players at the 30-yard line with 70-yards-to-go to reach said goal line adjacent to the one of said end zones initially selected for advancement, and said control board also awarding two points to said next player, with said next player starting with four of said at least four darts and said maximum time interval for player ball possession in which to use as many of said four darts as is needed to achieve a 10-yard gain;

(p) when any one of said up to four darts is thrown and completely misses said game board, said players will communicate said miss to said control board, with said control board registering a loss of down; and (q) said game play continuing with steps (h) through (n) until all of said time intervals for said quarters of game play have elapsed, with said player having the most points at such time being the winner.

14. The method of claim 13 further comprising a step of said players intending to use said electronic dart football game of claim 1 selecting a referee to act as a final arbiter of all disputes, with said step being implemented prior to said step of said first player throwing a first dart to activate said control board.

15. The method of claim 13 further comprising two additional referee penalty areas located in each of said end zones.

16. The method of claim 13 wherein said control board switches end zones for said players at the end of each of said four quarters of game play.

17. The method of claim 13 further comprising an option for said players to achieve two bonus points after reaching a goal line by forward advancement wherein when said player reaching said goal line throws one dart at the game board and if it makes contact with one of said scoring areas marked with a yard gain of at least fifteen yards said control board would award said goal line reaching player two points.

18. The method of claim 13 wherein said players have no time outs to stop said time intervals of game play.

19. The method of claim 13 wherein said game board further comprises additional horizontally-extending lines positioned between said goal lines that are numerically marked to represent 5-yard increments, with at least one of said additional horizontally-extending lines being centrally located between every two adjacent ones of said horizontally-extending lines numerically marked to represent consecutive 10-yard increments, and further with at least one of said additional horizontally-extending lines being centrally located between each of said goal lines and the next adjacent one of said horizontally-extending lines numerically marked to represent a 10-yard increment, and wherein when said time intervals of game play have elapsed, and in addition when another one of said players has interrupted the one of said players currently throwing a dart and prevented said player from making a good dart throw toward said game board before said time intervals of game play elapsed, and said game clock or possession clock ran out, said interrupted player is allowed to finish the throw as if on the 5-yard line with 5-yards-to-go, with the outcome of the next dart throw determining whether a touchdown is made, and if a touchdown is not made, said control board turning ball possession over to said interrupting player on the same 5-yard line, with ninety-five yards-to-go, with said interrupting player starting with four of said at least four darts and said maximum time interval for player ball possession in which to use as many of said four darts as is needed to achieve a 10-yard gain.

20. The method of claim 13 wherein the order of said steps (b) through (e) is not critical.

21. The method of claim 13 wherein said game board further comprises additional horizontally-extending lines positioned between said goal lines that are numerically marked to represent 5-yard increments, with at least one of said additional horizontally-extending lines being centrally located between every two adjacent ones of said horizontally-extending lines numerically marked to represent consecutive 10-yard increments, and further with at least one of said additional horizontally-extending lines being centrally located between each of said goal lines and the next adjacent one of said horizontally-extending lines numerically marked to represent a 10-yard increment, and when said first player does not achieve a first down and punts by throwing the third or fourth one of said four darts toward said game board after communicating an intention to punt to said control board, said control board turning ball possession over to a next one of said players at the one of said additional horizontally-extending lines positioned between said goal lines that are numerically marked to represent 5-yard increments immediately forward of the location where said punting dart makes contact with said game board, with said next player starting with four of said at least four darts and said maximum time interval for player ball possession in which to use as many of said four darts as is needed to achieve a 10-yard gain.

22. The method of claim 13 further comprising the steps of providing a remote control device and electronically connecting said remote control device to said control board so that a player holding said remote control device is able to communicate via said remote control device with said control board, and wherein said steps herein occur prior to said step of said first player throwing a first one of said darts at said game board to activate said control board.

* * * * *